United States Patent [19]

Michel et al.

[11] Patent Number: 4,572,099

[45] Date of Patent: Feb. 25, 1986

[54] APPARATUS FOR SELECTIVE ONE AND TWO-SIDED COATING OF ENDLESS STRIPS OF SHEET STOCK

[75] Inventors: Rolf Michel, Drensteinfurt; Klaus Fromman, Meerbusch, both of Fed. Rep. of Germany

[73] Assignee: Mannesmann AG, Duesseldorf, Fed. Rep. of Germany

[21] Appl. No.: 598,012

[22] Filed: Apr. 9, 1984

[30] Foreign Application Priority Data

Apr. 13, 1983 [DE] Fed. Rep. of Germany ..... 3313218

[51] Int. Cl.[4] ..... B05C 1/08; B05C 3/12

[52] U.S. Cl. ..... 118/68; 118/69; 118/206; 118/419

[58] Field of Search ..... 118/206, 419, 420, 65, 118/68, 69; 427/433, 434.2

[56] References Cited

U.S. PATENT DOCUMENTS 4,114,563 9/1978 Schnedler et al. ..... 118/419 X
4,446,812 5/1984 Wang ..... 118/206 X

FOREIGN PATENT DOCUMENTS 54-6824 1/1979 Japan ..... 118/419

*Primary Examiner*—John P. McIntosh
*Attorney, Agent, or Firm*—Ralf H. Siegemund

[57] ABSTRACT

Steel strip is run towards container containing liquid zinc, and is either deflected before reaching the surface or from an immersed position, by a second deflection roll; in the first case, a scooping roll flushes liquidous zinc against the strip. The strip is either run through a protective gas containing cooling path or through the outer atmosphere.

2 Claims, 2 Drawing Figures

APPARATUS FOR SELECTIVE ONE AND TWO-SIDED COATING OF ENDLESS STRIPS OF SHEET STOCK

BACKGROUND OF THE INVENTION

The present invention relates to selective one or two-sided coating of a continuous strip tape or the like, and more particularly the invention relates to zinc plating or coating of one or both sides of a steel strip.

Equipment of the type to which the invention pertains will include a coating or layering station proper preceded by a protective gas zone, and including a deflection pulley roll or the like rotatably mounted on a horizontal axis in the range of the coating material; further are including devices for the control of the thickness of the coating.

The demand for one or single side coated, particularly zinc-coated steel strip, has increased considerably in the recent past. This kind of material is used to a considerable extent for sheet stock used for making automobile parts, whereby particularly lacquer, varnish or other nonmetallic, usually synthetic coating or the like will be deposited on that side of the steel strip which is not zinc coated. The zinc coating is situated on the inside of the cabin or vehicle compartment made from such steel sheet stock and improves considerably the corrosion resistance of the sheet which in turn enhances considerably the life of the vehicle.

Modern zinc coating plants are usually designed for such a high throughput that the one sided coating will not be provide for sufficiency occupancy of the plant. Steel strip with a zinc coating on both sides is still in high demand. Therefore, the problem has arisen to provide equipment and zinc coating facilities which can be selectively operated for one or two sided coating.

In accordance with a known equipment and plant of the latter type, it has been suggested to run the stock to be coated along a lower peripheral portion of a rotatably mounted deflection roll which dips into the liquid metal. The deflection roll is wider than the strip material. The transition from a one sided to two sided coating and vice versa, is carried out in that the position of the line of contact between sheet stock and deflection roll is varied in relation to the surface level of the coating bath. If the strip or sheet engages the deflection roll already ahead of the point in which the roll dips into the liquid metal, then only the outer surface of the sheet stock will be coated; the side surface of the strip engaging the deflection roll is protected against coating thereby. On the other hand, if one lowers the deflection roll deeper in the bath and/or the sheet stock approaches the deflection roll at a shallower angle and is also taken up from the roll at a correspondingly shallower angle, layering and coating material will be able to penetrate into the more or less triangular space between the roll and that side of the strip which will be, but is not yet covered by, the roll following engagement. This way one does obtain a two-sided coating.

However, it was found that this particular kind of equipment is disadvantaged in those cases in which one is not in fact able to keep this one side of the strip or sheet clean from coating material. Through capillary action or otherwise, coating material may creep into the gap between the sheet and the deflection roll, particularly near and along the edges of that sheet material. However, the one sided coating does not merely require that the one side be basically free from coating material, it must be completely free from such a material, particularly because of the subsequently employed lacquering or varnishing of the uncoated side. See here for example German printed Patent Application 3,045,403.

Generally speaking equipment for the double or two-sided coating of a continuous running strip is usually comprised of a container in which is contained the liquidous coating material and one or two rolls are provided for rotation about horizontal axes, these rolls are journalled accordingly in the container, and the material to be coated is drawn under these rolls. Equipment of this type generally is disclosed, for example in German printed Patent Application 1,521,159a (corresponding U.S. patent application Ser. No. 445,201 of Oct. 2, 1965).

Additional equipment is known for the one-sided coating of strips which does not exhibit the drawbacks of that particular equipment mentioned above which is provided for the selective one and two sided coating. Thus, coating on one side only is carried out by equipment which makes sure that indeed only one side receives coating material, and this critical aspect is attained by running the strip above the coating medium around a horizontally journalled deflection roll, and by providing a scooping roll below that roll which dips into the coating material and runs otherwise axis parallel to the deflection roll. Equipment of this type is disclosed, for example, in German printed Patent Application 3,009,590.

DESCRIPTION OF THE INVENTION

It is an object of the present invention to provide a new and improved equipment for the selective one-sided and two-sided coating of continuous running strip sheet material, avoiding the drawbacks of the dual purpose equipment as outlined above, and approaching a quality as far as the resulting product is concerned which equals the quality of single purpose coating equipment.

It is a particular object of the present invention to provide a new and improved method and equipment for zinc plating and coating of steel strip under utilization of a coating station, a protective gas zone upstream from the coating station, and under further utilization of equipment that permits adjustment and control of the coating thickness.

It is a feature of the present invention to improve selective one and two-sided coating of strip under retention of the heretofore used deflection roll which is rotatably mounted for rotation about a horizontal axis.

In accordance with the preferred embodiment of the present invention it is suggested to provide a first deflection roll for rotation about an horizontal axis above the surface level of the coating material and to provide axis parallel thereto a scooping roll which dips with at least part of its circumference into the coating material; the two rolls are both situated in a gas type housing or casing which is open at the bottom but dips into the coating material so that the liquidous coating material in effect seals the interior of this housing; a gas-proof guide channel or duct is connected to this housing or casing at the entrance side thereof as far as strip and sheet entrance is concerned, which duct provides a communication to the heating facility of the coating station, while at the exit side of this housing a cooling path is connected which runs straight up and is under pressure of a protective gas; the equipment thus far is provided for the one-sided coating, while for two-sided coating another deflection roll is provided laterally below the first one but inside of the coating material possibly cooperating with a second cooling path which is open to the outer atmosphere.

Equipment of the type as per the preferred embodiment avoids particularly during two-sided coating, the formation of zinc streaks or "flowers". For this, a water-air mixture is blown upon the strip following emergence from the liquid zinc. In order to avoid the formation of zinc streaks, it is also necessary to provide a molten zinc bath which has a very low lead content. Moreover, the invention makes use of the fact that the two-sided coating does not require cooling in a protective gas atmosphere, though such procedure can readily be accomodated. However, in view of the zinc streak suppression by means of an air-water mixture cooling, an exclusion of air is simply not possible. Therefore, the cooling for the two-sided coating is normally carried out in ambient air.

The one-sided zinc-coated strip on the other hand has to run through a cooling path which is subject to protective gas in order to avoid oxidation of the side of the strip which does not receive any coating.

In order to obtain a particularly smooth surface of the coated material one should use an N2 operated nozzle meter which has to work in a protective gas atmosphere. This holds true particularly then for the formation of a one-sided coated product. In case of a two-sided coating, and in case one wishes smooth surfaces of these coatings, one should run the strip through the cooling path which is subject to the protective gas, following which cooling is carried out in air. It can thus be seen that the invention accommodates all possibilities and meets all the requirement necessary for the one or two-sided coating of steel strip, and particularly for the zinc coating thereof.

DESCRIPTION OF THE DRAWINGS

While the specification concludes with claims, particularly pointing out and distinctly claiming the subject matter which is regarded as the invention, it is believed that the invention, the objects and features of the invention and further objects, features and advantages thereof will be better understood from the following description taken iin connection with the accompanying drawings in which:

Proceeding now to the detailed description of the drawings, FIG. 1 illustrates a steel strip 1 which is selectively to be coated on one or both sides. Conventionally the strip 1 is run through a furnace or other suitable heating facility to for annealing for example at 800 degrees centigrade. The strip is then cooled down to the temperature necessary for a zinc coating which is about 460 degrees centigrade. A deflection roll 3 with horizontal axis runs the strip from the furnace down through a feeder channel which leads to a gas tight housing or casing 6. The channel or duct 4 is somewhat obliquely positioned, and at its lower end there is provided a gas lock 5*a*, which separates the duct 4 proper from the interior of the casing or housing 6. It should be noted that the interior of the furnace 2 and the duct 4 is under a protective gas atmosphere.

Figure 1:
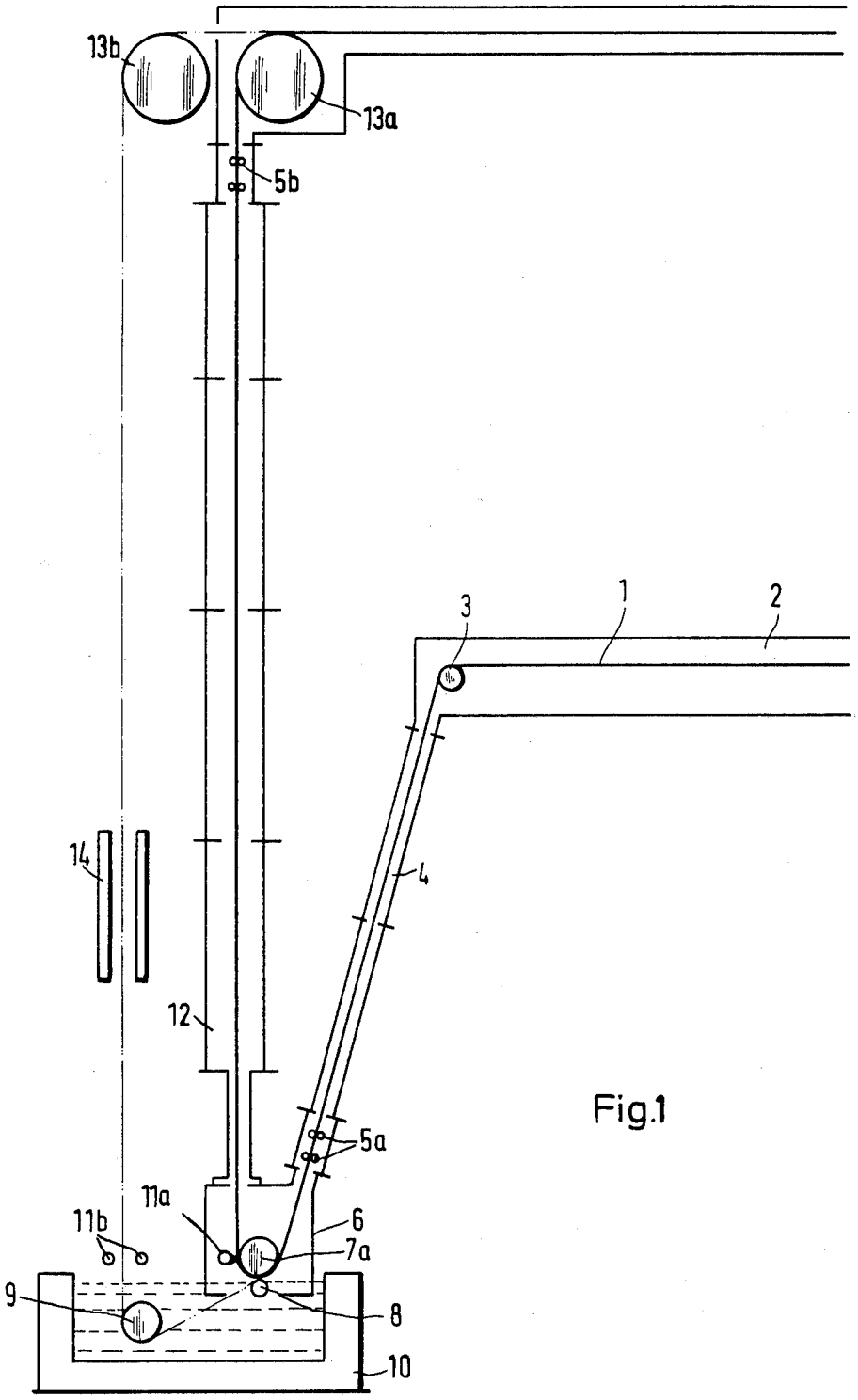
FIG. 1 is a schematic side elevation of a first example for the preferred embodiment of the present invention for practicing the best mode thereof.

Reference numeral 10 refers to a container, trough, pan or the like which contains the coating material such as liquid zinc. The casing 6 is disposed basically above the container 10, but it can be seen that this casing 6 is open at the bottom and the liquid bath in the container 10 closes that bottom.

A deflection roll 7*a* is disposed inside housing or casing 6 well above the surface level of the zinc bath in container 10. The roll 7*a* is rotatably mounted for rotation about a horizontal axis. The strip material 1 loops around the deflection roll 7*a*, and leaves that roll in a 9:00 o'clock position so as to run straight up and into and through a cooling duct and cooling path 12.

A scooping roll 8 is provided underneath deflection roll 7*a*, and dips partially into the liquid metal contained in container 10. This scooping roll feeds and flushes coating material towards and against the surface of strip 1 facing out from the deflection roll 7*a*. The side of the strip 1 facing in the opposite direction and being protected by the roll 7*a* will remain completely free from any coating material.

The thickness of the resulting coating is controlled under utilization of an air meter 11*a*. The cooling duct 12 is likewise filled with a protective gas atmosphere so that it as well as the furnace 2 will avoid oxidation of that side of the strip which is not to be coated. After running through another gas lock 5*b* on the top of cooling duct 12, the coated strip is deflected by the upper roll 13*a* so as to be veered into the horizontal.

The equipment as described thus far is provided for one-sided coating. Now, in order to provide two-sided coating, the equipment includes in the same container 10 a laterally displaced and additional deflection roll 9 clearly disposed below the deflection roll 7*a*. Roll 9 runs inside the coating material in the container 10, and is likewise rotatable about a horizontal axis. Immersion of roll 9 is essential.

The strip 1 is now run from the deflection roll 7*a* towards the deflection roll 9, whereby the roll 7*a* serves merely the purpose of a guide. The strip material now passes in an exposing fashion through the bath in container 10 and leaves the deflection 9 roll also in a 9:00 o'clock position to be run straight up.

The thickness of the coating on both sides is adjusted conventionally through two air meters 11*b* arranged adjacent opposite sides of the coated strip.

Thus far the equipment has been described basically independent from the particular material involved, but if it is assumed that a zinc coating is provided for, then, as stated, formation of the infamous zinc oxide streaks have to be prevented. The requisite suppression device is likewise known per se, and includes the more schematic indicated water-air spray structure 14. The strip 1 runs through regular outer atmosphere to be cooled. Protective gas is not needed because the two-sided coating in fact acts as a inhibitor for steel oxidation. A second top deflection roll 13*b* veers the strip material into the horizontal so that the extraction of strip material follows thereafter the same path regarded whether one-sided or two-sided coating has been provided.

The equipment shown in FIG. 1 thus includes all necessary components in order to obtain a selective one-sided and a two-sided coating, whereby the product that results is endowed with the same quality it would have if the alternative mode of coating were not provided for. It can also be seen that within a very short period of time the equipment can be changed from a one-sided to a two-sided coating, and vice versa. In the essence, one merely needs to re-thread the leader of the strip or sheet stock through the equipment. The specific equipment needed for one mode of operation is no impediment for obtaining the other mode of operation, whereby particularly the roll 7*a* is used in a dual function. It is in one case the particular device against which the strip is held while being coated on the opposite, while in the case for a two-sided coating the roll 7*a* is used as a guide facility to run the strip to the deflection roll 9 that is immersed and is therefore directly instrumental in obtaining fully two-sided coating.

Figure 2:
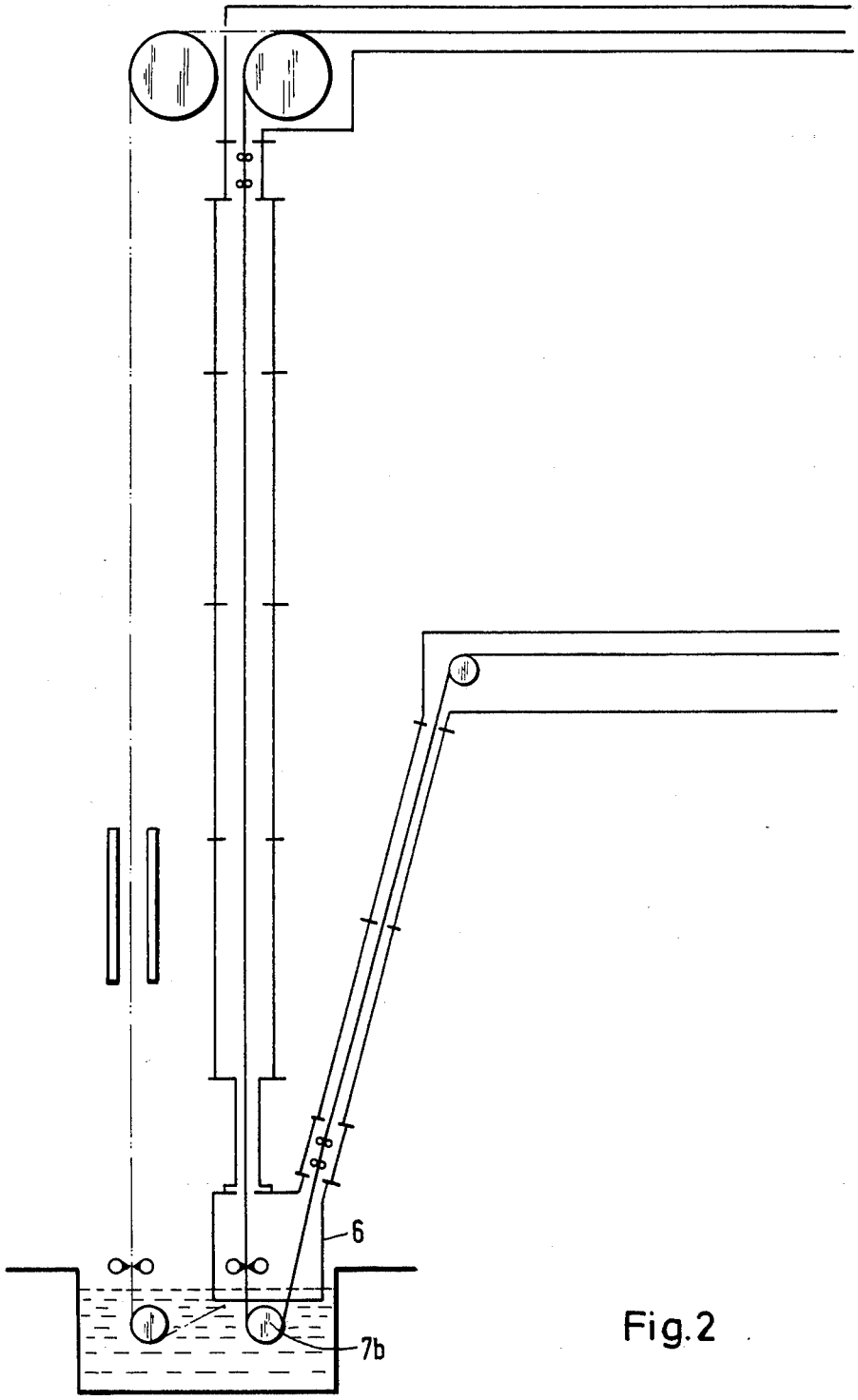
FIG. 2 is a modified example still constituting the preferred embodiment of the invention, and demonstrating versatility of the concept underlying the system.

It can readily be seen that the two-sided coated strip will normally run through regular atmosphere, but alternatively a protective gas atmosphere can be provided for if needed in a general sense. FIG. 2 now illustrates how in fact the already existing protective gas atmosphere in the exit duct 12 of FIG. 1 can be used in those cases in which for the two-sided coating a cooling within a protective gas atmosphere is desired. This in fact can be regarded as a third mode of operation. In this case then, and here we turn to FIG. 2, the deflection roll 7*a* will be replaced by a smaller deflection roll 7*b*, which is also immersed fully in the bath of the container 10. The roll 7*b* is somewhat smaller than the roll 7*a*. The difference in diameter is chosen such that the strip as it is run into the bath can still descend from a submersed position straight up into the duct 12.

It has to be considered in this regard that the two ducts 4 and 12 in fact have converging direction so that the radius of deflection in the submersed instance of FIG. 2 has to be somewhat smaller than the radius of deflection by the roll 7*a* in FIG. 1. Also the scooping roll 8 has to be eliminated or removed, and a replacement or set of air meters 11' is provided here for purposes of controlling the coating thickness.

The invention is not limited to the embodiments described above, but all changes and modifications thereof not constituting departures from the spirit and scope of the invention are intended to be included.

We claim:

1. Apparatus for selective one-sided and two-sided coating of a continuous running strip or sheet, there being a protective gas filled feeder duct, and a coating material filled container underneath, further comprising;

a first deflection roll mounted for rotation about a horizontal axis, the strip to be coated partially looping around said roll;

a scooping roll disposed underneath said deflection roll and mounted also for rotation on a horizontal axis further situated to flush scooped liquidous coating material against that surface of the strip or sheet facing away from the deflection roll about which it is looped;

a casing open at the bottom and sealingly connected to said feeder duct and being gas tight but closed at the bottom of the coating material and containing said deflection and scooping rolls;

a basically closed, first cooling path and duct containing protective gas and being connected to said casing, said strip or sheet when running off said deflection roll running into and through said cooling duct;

a second deflection roll immersed in and said bath for selectively receiving and deflecting said strip, said strip or sheet when running off said second deflection roll running through a second, basically open atmospheric cooling path; and means for directing said strip or sheet from said first and second cooling paths into a common output and exit path.

2. Apparatus for selective one-sided and two-sided coating of a continuous running strip or sheet, there being a protective gas filled feeder duct, and a coating material filled container underneath and for protective gas and open air cooling, further comprising;

means (a) comprising a first deflection roll mounted for rotation about a horizontal axis, the strip to be coated partially looping around said roll, and a scooping roll disposed underneath said first deflection roll and mounted also for rotation on a horizontal axis, the scooping roll further situated to flush scooped liquidous coating material against that surface of the strip or sheet facing away from the deflection roll about which it is looped;

a casing open at the bottom and sealingly connected to said feeder duct and being gas tight but closed at the bottom by the coating material and containing said deflection and scooping rolls;

a basically closed, first cooling path and duct containing protective gas and being connected to said casing, said strip or sheet when running off said deflection roll running into and through said cooling duct;

means (b) comprising a second deflection roll having a diameter smaller than the first deflection roll and being fully immersed in said bath and situated to run said strip or sheet from a fully immersed position into said cooling duct, being filled with protective gas;

only one of the means (a) and the means (b) being present at a time;

a third deflection roll immersed in said bath for selectively receiving and deflecting said strip, said strip or sheet when running off said third deflection roll running through a second, basically open atmospheric cooling path; and means for directing said strip or sheet from said first and second cooling paths into a common output and exit path.

* * * * *